US008062506B2

(12) United States Patent
Hedrick et al.

(10) Patent No.: US 8,062,506 B2
(45) Date of Patent: Nov. 22, 2011

(54) PROCESS FOR CONTACTING HIGH CONTAMINATED FEEDSTOCKS WITH CATALYST IN AN FCC UNIT

(75) Inventors: Brian W. Hedrick, Oregon, IL (US); Paolo Palmas, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 12/814,785

(22) Filed: Jun. 14, 2010

(65) Prior Publication Data

US 2010/0243529 A1 Sep. 30, 2010

Related U.S. Application Data

(62) Division of application No. 11/463,497, filed on Aug. 9, 2006, now Pat. No. 7,758,817.

(51) Int. Cl.
*C10G 11/18* (2006.01)

(52) U.S. Cl. ..... 208/113

(58) Field of Classification Search ..... 208/113
See application file for complete search history.

(56) References Cited

U.S. PATENT DOCUMENTS

| | | | | | |
|---|---|---|---|---|---|
| 3,531,398 | A | * | 9/1970 | Adams et al. | 208/211 |
| 4,534,854 | A | * | 8/1985 | Weinberg et al. | 208/131 |
| 4,675,099 | A | * | 6/1987 | Skraba | 208/57 |
| 4,713,169 | A | * | 12/1987 | Nielsen | 208/113 |

* cited by examiner

*Primary Examiner* — Glenn Caldarola
*Assistant Examiner* — Randy Boyer
(74) *Attorney, Agent, or Firm* — James C Paschall

(57) ABSTRACT

An FCC process comprising an enlarged riser section and a distributor in an elevated position and with an opening in its tip away from riser walls may reduce coke build-up along the interior walls of a riser. Catalytic mixing may be improved, which could reduce riser coking by increasing hydrocarbon contact with catalyst before contacting the riser wall. Increasing the distance between the introduction of the hydrocarbon and the riser wall may increase this likelihood for hydrocarbon-catalyst contact. Highly contaminated hydrocarbons cause greater coking than do normal hydrocarbons and this FCC process may be effective in decreasing riser coking on such heavy hydrocarbons.

5 Claims, 4 Drawing Sheets

PROCESS FOR CONTACTING HIGH CONTAMINATED FEEDSTOCKS WITH CATALYST IN AN FCC UNIT

CROSS-REFERENCE TO RELATED APPLICATION

This application is a Division of copending application Ser. No. 11/463,497 filed Aug. 9, 2006, the contents of which are hereby incorporated by reference in its entirety.

BACKGROUND OF THE INVENTION

This invention relates generally to a process for catalytic cracking of hydrocarbons.

DESCRIPTION OF THE PRIOR ART

Fluid catalytic cracking (FCC) is a catalytic conversion process for cracking heavy hydrocarbons into lighter hydrocarbons accomplished by contacting the heavy hydrocarbons in a fluidized reaction zone with a catalyst composed of finely divided particulate material. Most FCC units use zeolite-containing catalyst having high activity and selectivity. As the cracking reaction proceeds, substantial amounts of highly carbonaceous material referred to as coke are deposited on the catalyst, forming spent catalyst. High temperature regeneration burns coke from the spent catalyst. The regenerated catalyst may be cooled before being returned to the reaction zone. Spent catalyst is continually removed from the reaction zone and replaced by essentially coke- free catalyst from the regeneration zone.

The basic components of the FCC process include a riser (internal or external), a reactor vessel for disengaging spent catalyst from product vapors, a regenerator and a catalyst stripper. In the riser, a feed distributor inputs the hydrocarbon feed which contacts the catalyst and is cracked into a product stream containing lighter hydrocarbons. Regenerated catalyst and the hydrocarbon feed are transported upwardly in the riser by the expansion of the lift gases that result from the vaporization of the hydrocarbons, and other fluidizing mediums, upon contact with the hot catalyst. Steam or an inert gas may be used to accelerate catalyst in a first section of the riser prior to or during introduction of the feed.

A problem for the FCC process is the generation of coke on the riser wall, called riser coking Coke builds up along the wall where the feed contacts the wall. Excessive coke build-up can upset the hydraulic balance in a unit to the point where it is eventually forced to shut down. The processing of heavier feeds such as residual and crude hydrocarbons can exacerbate the coke production problem due to their higher coking tendencies.

SUMMARY OF THE INVENTION

An FCC process may include a riser having a lower section with an enlarged diameter where the hydrocarbon is fed into the riser. One aspect of the invention may be the position of the distributor tip inside the interior of the enlarged lower section of the riser away from the wall of the riser and above the introduction of catalyst and steam. The position of the distributor tip away from the interior wall, the enlarged diameter of the lower section of the riser, and the elevated introduction of the feed above the introduction of the catalyst and steam may increase catalyst mixing with the feed. As a result, riser coking may decrease. Decreased riser coking may be useful in the FCC process, especially when the hydrocarbon is a heavy feedstock.

DETAILED DESCRIPTION

This invention relates generally to an improved FCC process. Specifically, this invention may relate to an improved riser and distributor arrangement and may be useful for FCC operation to decrease generation of coke on the riser wall. The process aspects of this invention may be used in the design of new FCC units or to modify the operation of existing FCC units.

Figure 1:
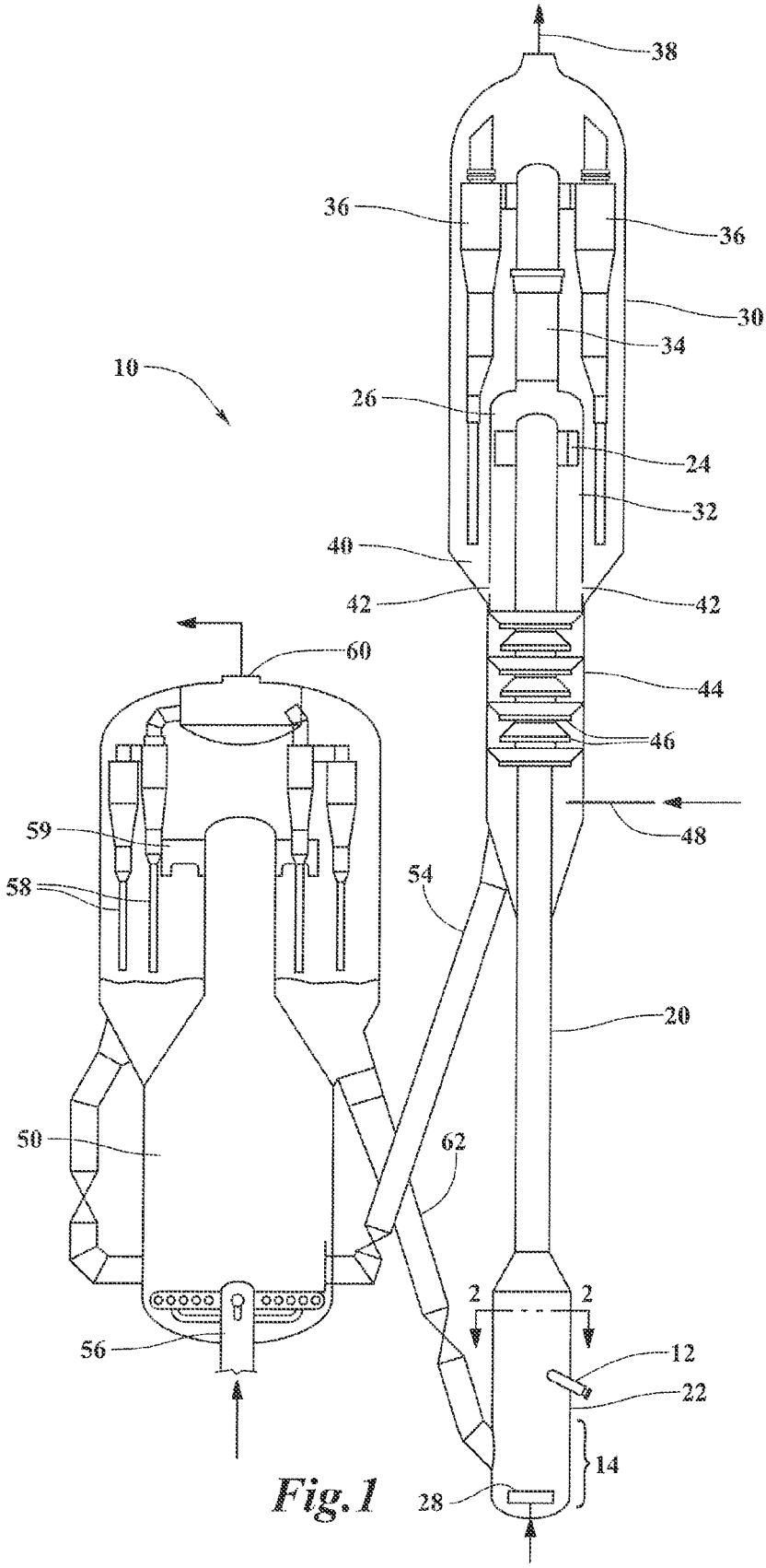
FIG. 1 is an elevational diagram showing an FCC unit.

As shown in FIG. 1, an FCC unit 10 may be utilized in the FCC process, which may include feeding hydrocarbon into a riser 20 in the presence of a catalyst. In general, hydrocarbon may be cracked in the riser 20 in the presence of catalyst to form a cracked stream. A reactor vessel 30, with a separation chamber 32, separates spent catalyst particles from the cracked stream. A stripping zone 44 removes residual adsorbed hydrocarbon from the surface of the catalyst optionally as the catalyst travels over baffles 46. Spent catalyst from the stripping zone 44 is regenerated in a regenerator 50 having one or more stages of regeneration. Regenerated catalyst from the regenerator 50 re-enters the riser 20 to continue the process. The process could be scaled up or down, as would be apparent to one in the art.

FCC feedstocks for processing by the method of this invention may include heavy or residual feeds as well as conventional FCC feeds. The most common of the conventional feeds is a vacuum gas oil which is typically a hydrocarbon material having a boiling range of from 343° to 551° C. (650° to 1025° F.) and is prepared by vacuum fractionation of atmospheric residue. Heavy or residual feeds may have a boiling point above 449° C. (930° F.). The invention is particularly suited to crude feed stocks. High quality crude feed having very little distillate material, such as waxy crudes that typically have an API gravity index of 25° or greater but a pour point of greater than 38° C. (100° F.) and which makes them difficult to ship via pipeline. Other heavy crudes have very high viscosity making shipping by pipeline very expensive. Such crudes can have API gravity indices of 18° or less and viscosities greater than 10,000 cSt at 38° C. Moreover, these crudes can contain as much as 12.9 wt-% of Conradson carbon and as much as 250 wppm of nickel and vanadium. A fraction of these crudes boiling above 343° C. (650° F.) can be subjected fluid catalytic cracking to produce a cutter stock that can be blended with other crude feed stock to reduce the pour point or the viscosity or increase the API gravity index of the blended crude stream. In one embodiment, an FCC unit may process heavier feedstocks that are between about 5 and about 20 wt-% Conradson carbon, preferably between about 8 and about 15 wt-%. Feed may have an API gravity of between about 8 and about 22 and an average molecular weight of between about 300 and about 500. Furthermore, the feed may have as little as 15 wppm nickel plus vanadium and may be as high as 250 wppm nickel plus vanadium and between about 0.5 and about 5 wt-% sulfur. Hydrocarbon feed may be modified to other feeds with appropriate modifications such as understood by those in the art.

Referring to FIG. 1, riser 20 provides a conversion zone for cracking of the feed hydrocarbons and has an enlarged lower section 22. The enlarged lower section 22 of the riser 20 may be greater in diameter than the riser 20 by between about 50% and about 500%, preferably between about 100% and 400%.

The diameter of the enlarged section will be sized to generate superficial gas velocity in the enlarged section of about 0.9 to about 1.5 m/sec (3 to 5 ft/sec) to obtain a bubbling bed.

Figure 2:
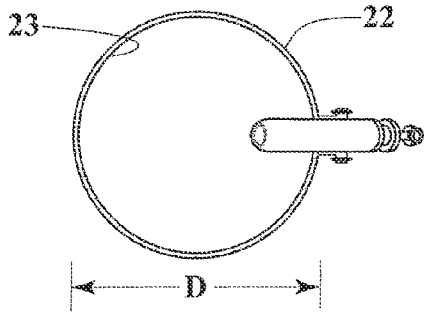
FIG. 2 is a cross section taken along segment 2-2 in FIG. 1.
Figure 3:
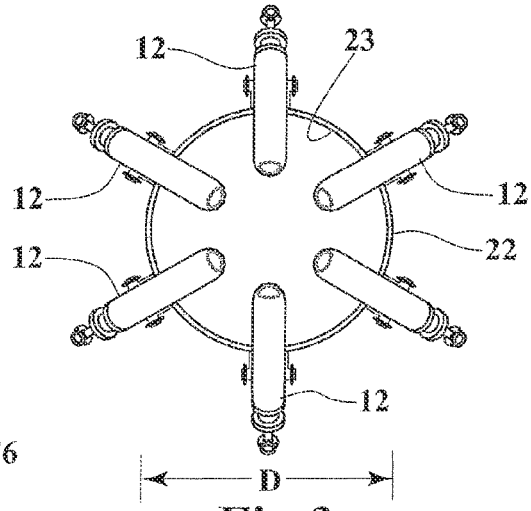
FIG. 3 is a cross section showing an embodiment with six distributors.

As shown in FIG. 2, feed may be injected through one or more individual feed distributors 12 into the enlarged section of the riser having an inner diameter D. The distributor 12 may be positioned above the introduction of catalyst. Preferably, a plurality of feed distributors 12 may be utilized. In one embodiment, two, three, four or more feed distributor nozzles may be arranged generally uniformly around the enlarged lower section 22 of the riser 20. In a preferred embodiment, as depicted in FIG. 3, six feed distributors 12 may be arranged radially around the enlarged lower section 22 having inner diameter D. The tip 88 of each distributor 12 may extend into the interior of the enlarged lower section 22. In a preferred embodiment, the tip 88 may extend into the interior of the enlarged lower section 22 such that all of the openings 86 are spaced from a closest part of an inner surface of the wall 23 by between about 10% and about 40% of the inner diameter of the enlarged lower section 22, preferably about 25 to about 35%, and still even more preferably about 33%.

Figure 4:
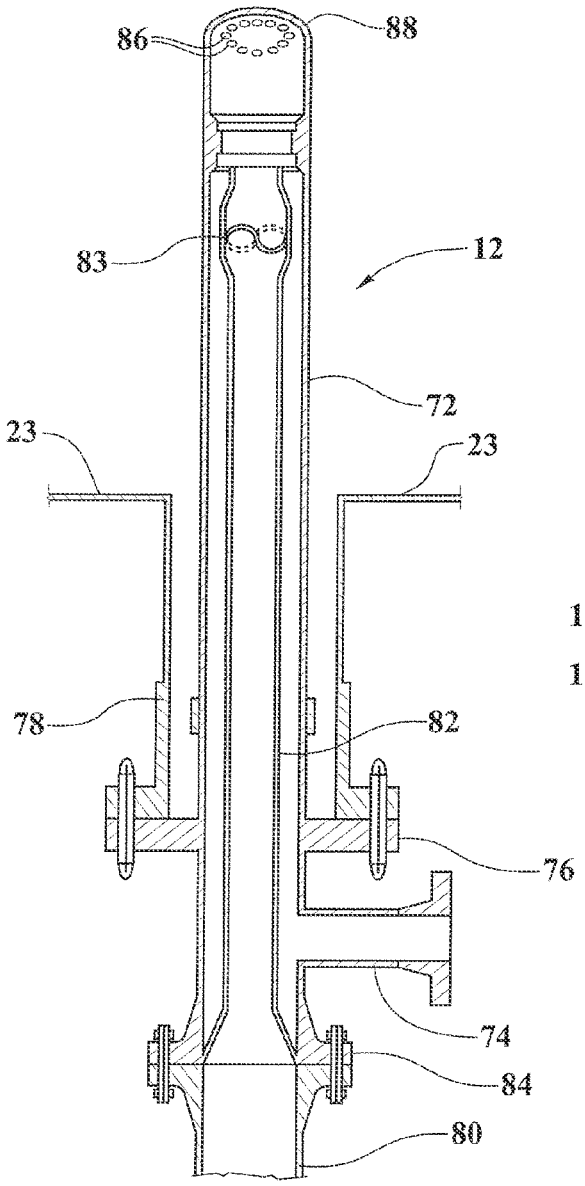
FIG. 4 is an elevational diagram showing a feed distributor.

As shown in FIG. 4, hydrocarbon and steam may be introduced through the feed distributor 12. In one embodiment, a distributor barrel 72 for each distributor 12 receives steam from a steam inlet pipe 74. A barrel body flange 76 secures the distributor barrel 72 to a riser nozzle 78 in the reactor enlarged lower section 22 by bolts and may be oriented such that the bolt holes straddle a radial centerline of the enlarged lower section 22. An oil inlet pipe 80 delivers hydrocarbon feed to an internal oil pipe 82. An oil inlet barrel flange 84 secures the oil inlet pipe 80 to the distributor barrel 72 by bolts. Vanes 83 in the internal oil pipe 82 cause the oil to swirl in the oil pipe before exiting. The internal oil pipe 82 distributes swirling oil to the distributor barrel 72 where it mixes with steam and is injected from orifices, or openings, 86 in the distributor tip 88 extending into the enlarged lower section 22.

Figure 6:
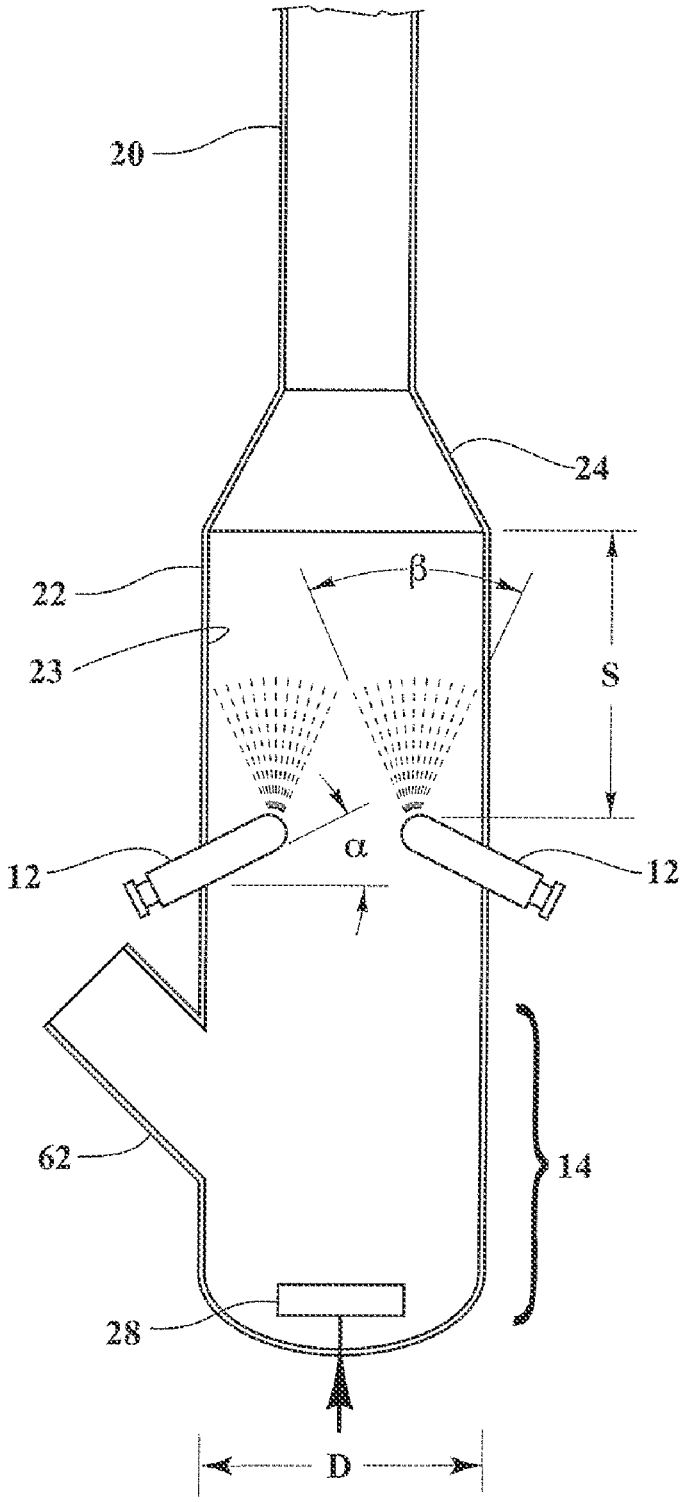
FIG. 6 is a cross section showing an enlarged lower section of the riser.

As shown in FIG. 6, each distributor 12 may be inclined to point the opening 86 of the distributor tip 88 at an upward angle a relative to horizontal to inject the feed up the enlarged lower section 22 of the riser 20. Preferably, this upward angle $\alpha$ is between about 15 and about 60 degrees to the horizon, and more preferably between about 20 and about 40.

Figure 5:
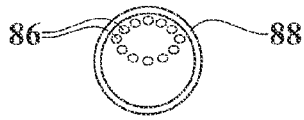
FIG. 5 is an elevational diagram showing a distributor tip.

As shown in FIGS. 4 and 5, the injection of feed is through one or more openings 86 in the distributor tip 88. The openings 86 may be positioned on the upwardly facing part of the tip 88 when the distributor 12 is inclined at angle $\alpha$. In a preferred embodiment, about 5 to about 15 openings 86 are provided in the tip 88. In a still more preferred embodiment, as depicted in FIGS. 4 and 5, about 12 openings 86 may be provided in the tip 88, but more or less openings may be suitable. The openings 86, preferably, are arranged in an oval or circular pattern on the tip 88. Each opening may have a diameter of about 0.6 cm (0.25 inch), preferably between about 1.3 cm and 1.9 cm (0.5 and 0.75 inch), and still more preferred about 1.6 cm (0.63 inch).

In one embodiment, as shown in FIG. 6, the feed spray pattern, when injected through the distributor tip using the about 12 openings 86 in the oval arrangement, may have a conical shape, preferably hollow about a vertical centerline and a cone angle $\beta$ between about 30 degrees and about 80 degrees, more preferably between about 45 and 75 degrees, and still even more preferably about 60 degrees. The feed spray may be directed upwardly into the enlarged lower section 22 having diameter D.

In an alternative embodiment, the openings 86 in the distributor tip 88 can be arranged to generate spray in a flat fan defining an angle of spray of such as 90 degrees. The openings 86 and the tip 88 can be arranged to define an angle with respect to the horizontal such as 30 degrees which is compounded when the distributor 12 is angled with respect to the horizontal. For example, the openings 86 may be 30 degrees to the horizontal and when the distributor 12 is inclined 30 degrees with respect to the horizontal, the fan can generate an angle of 60 degrees with respect to the horizontal. In a third alternative embodiment, the cross-section of the enlarged portion 22 may be divided up into a plurality of concentric annular regions above the openings 86 such as three concentric annular regions. The openings 86 in each of the distributors 12 can be arranged, so that the feed is equally proportionate to the areas of each of the annular regions at preferably one vessel diameter above the openings 86.

It is also contemplated that each of the distributors 12 or each of the openings in the distributors 86 may extend into the enlarged lower section 22 at different radial positions to ensure equal proportionation across the cross section of the enlarged lower section 22 of the feed sprayed from the openings.

The feed rate in the distributor 12 may have a velocity of between about 15 and about 46 meters per second (50 and 150 feet per second), preferably between about 23 and about 38 meters per second (75 and 125 feet per second), and still more preferred at about 30 meters per second (100 feet per second). The feed pressure in the distributor may be between about 69 and about 345 kPa (gauge) (10 and 50 psig), preferably between about 103 and about 241 kPa (gauge) (15 and 35 psig), and still more preferably about 172 kPa (gauge) (25 psig). The steam on feed of the distributor may be between about 2 and about 7 wt-%, and preferably between about 3 and about 6 wt-%.

Referring to FIG. 1, the injected feed mixes with a fluidized bed of catalyst. The fluidized bed of catalyst moves upwardly from the bottom part of the enlarged lower section 22. In one embodiment, the rate for the fluidized bed of catalyst to pass through the bottom of the enlarged lower section 22 to reach the distributor 12 may be at a velocity of between about 9 and about 30 centimeters per second (0.3 and 1 feet per second), preferably between about 18 and about 24 centimeters per second (0.6 and 0.8 feet per second), and still more preferably about 21 centimeters per second (0.7 feet per second). Steam or other inert gas may be employed as a diluent through a steam distributor 28. Steam, of between about 1 and about 8 wt-% and preferably between about 2 and about 6 wt-% may be utilized as a lift and at a velocity of between about 45 and 183 centimeters per second (1.5 and 6 feet per second). When high Conradson carbon feed is used, higher steam rates are usually employed. Only the steam distributor 28 is shown in the FIGURES. However, other steam distributors may be provided along the riser 20 and elsewhere in the FCC unit. The mixture of feed, steam and catalyst travels up the enlarged lower section 22 at a velocity of between about 2.4 and about 6.1 meters per second (8 and 20 feet per second), preferably between about 3.7 and about 5.5 meters per second (12 and 18 feet per second), and more preferably about 4.6 meters per second (15 feet per second).

Referring to FIG. 6, in one embodiment, the distance S from the distributor tip 88 to the top of the enlarged lower section 22, where the diameter transitions through a frusto-conical transition section 24 into the narrower riser 20, may be between about 1.8 and about 4.9 meters (6 and 16 feet), preferably between about 2.4 and about 3.7 meters (8 and 12 feet), and still more preferably about 3.1 meters (10 feet). The distance S may be approximately equal to the diameter D of the enlarged lower section 22. However, it is most desirable that transition section 24 be spaced from the openings 86 in the tip 88 of the distributor 12 by a sufficient distance to ensure that feed jets from the openings 86 do not contact the wall before contacting a catalyst particle. This spacing will prevent accumulation of coke deposits on the wall of the riser. In the riser 20, the velocity increases to between about 12.2 and about 24.4 meters per second (40 to 80 feet per second) and preferably between about 15.2 and about 21.3 meters per second (50 and 70 feet per second).

The riser 20 may operate with catalyst to oil ratio of between about 8 and about 12, preferably at about 10. Steam to the riser 20 may be between about 3 and about 15 wt-% feed, preferably between about 5 and about 12 wt-%. Before contacting the catalyst, the raw oil feed may have a temperature in a range of from about 149° to about 316° C. (300 to 600° F.), preferably between about 204° and about 260° C. (400° and 500° F.), and still more preferably at about 232° C. (450° F.).

As shown in FIG. 1, in the reactor 30 of the FCC unit, the blended catalyst and reacted feed vapors are then discharged from the top of the riser 20 through the riser outlet 24 and separated into a cracked product vapor stream and a collection of catalyst particles covered with substantial quantities of coke and generally referred to as "coked catalyst." Various arrangements of separators to remove coked catalyst from the product stream quickly may be utilized. In particular, a swirl arm arrangement 26, provided at the end of the riser 20, may further enhance initial catalyst and cracked hydrocarbon separation by imparting a tangential velocity to the exiting catalyst and cracked product vapor stream mixture. The swirl arm arrangement 26 is located in an upper portion of the separation chamber 32, and the stripping zone 44 is situated in the lower portion of the separation chamber 32. Catalyst separated by the swirl arm arrangement 26 drops down into the stripping zone 44.

The reactor 20 temperature may operate at a range of between about 427° and 649° C. (800° and 1200° F.), preferably between about 482° and about 593° C. (900° and 1100° F.) and still more preferably at about 523° C. (975° F.). The reactor 20 may be between about 103 and about 241 kPa (gauge) (15 and 35 psig), preferably at about 138 kPa (gauge) (20 psig).

The cracked product vapor stream comprising cracked hydrocarbons including gasoline and light olefins and some catalyst may exit the separation chamber 32 via a gas conduit 34 in communication with cyclones 36. The cyclones 36 may remove remaining catalyst particles from the product vapor stream to reduce particle concentrations to very low levels. The product vapor stream may exit the top of the reactor 30 through a product outlet 38. Catalyst separated by the cyclones 36 returns to the reactor 30 through diplegs into a dense bed 40 where catalyst will pass through openings 42 and enter the stripping zone 44. The stripping zone 44 removes adsorbed hydrocarbons from the surface of the catalyst by counter-current contact with steam over the optional baffles 46. Steam may enter the stripping zone 44 through a line 48.

On the regeneration side of the process, also depicted in FIG. 1, coked catalyst transferred to the regenerator 50 via the coked catalyst conduit 54 undergoes the typical combustion of coke from the surface of the catalyst particles by contact with an oxygen-containing gas. The oxygen-containing gas enters the bottom of the regenerator 50 via a regenerator distributor 56 and passes through a dense fluidizing bed of catalyst. Flue gas consisting primarily of $N_2$, $H_2O$, $O_2$, $CO_2$ and perhaps containing CO passes upwardly from the dense bed into a dilute phase of the regenerator 50. A primary separator, such as a tee disengager 59, initially separates catalyst from flue gas. Regenerator cyclones 58 or other means, removes entrained catalyst particles from the rising flue gas before the flue gas exits the vessel through an outlet 60. Combustion of coke from the catalyst particles raises the temperatures of the catalyst which is withdrawn by a regenerator standpipe 62. The regenerator standpipe 62 passes regenerated catalyst from the regenerator 50 into the enlarged section 22 of the riser 20 at a rate regulated by a control valve. Fluidizing gas such as steam passed into the enlarged lower section 22 by a steam distributor 28 contacts the catalyst in a bottom zone 14 and lifts it in the enlarged lower section to contact the feed from distributors 12. In an embodiment, the bottom zone 14 where catalyst and fluidizing gas are mixed is below all of the openings 86 in the distributors 12. Regenerated catalyst from the regenerator standpipe 18 will usually have a temperature in a range from about 649° and about 760° C. (1200° to 1400° F).The dry air rate to the regenerator may be between about 3.6 and about 6.3 kg/kg coke (8 and 14 lbs/lb coke). The hydrogen in coke may be between about 4 and about 8 wt-%, preferably at about 6 wt-%, and the sulfur in coke may be between about 0.6 and about 1.0 wt-%, preferably about 0.8 wt-%. The process and feed with the high Conradson carbon content cooling methods may be most suitable for effective operation. Catalyst coolers on the regenerator may be used. Additionally, the regenerator may be operated under partial burn conditions. Moreover, water or light cycle oil may be added to the bottom of the riser to maintain the FCC unit in the appropriate temperature range. The conversion may be between about 55 and about 80 vol-% as produced. Conversion is defined by conversion to gasoline and lighter products with 90 vol-% of the gasoline product boiling at or below 193° C. (380° F.) using ASTM D-86. The zeolitic molecular sieves used in typical FCC gasoline mode operation have a large average pore size and are suitable for the present invention. Molecular sieves with a large pore size have pores with openings of greater than 0.7 nm in effective diameter defined by greater than 10 and typically 12 membered rings. Pore Size Indices of large pores are above about 31. Suitable large pore molecular sieves include synthetic zeolites such as X-type and Y-type zeolites, mordenite and faujasite. Y zeolites with low rare earth content are preferred. Low rare earth content denotes less than or equal to about 1.0 wt-% rare earth oxide on the zeolitic portion of the catalyst. Catalyst additive may be added to the catalyst composition during operation.

In one embodiment, a product yield of debutanized gasoline 90 wt-% boiling at or below 193° C. (380° F.) may be between about 30 and about 45 wt-%, preferably between about 35 and about 40 wt-%, and still more preferably about 38 wt-%. Light cycle oil 90 wt-% boiling at or below 316° C. (600° F.) yield may be between about 15 and about 25 wt-%, preferably about 20 wt-%. Clarified oil yield may be between about 10 and about 16 wt-%, preferably about 13.7 wt-%.

Coke yield may be between about 13 and about 20 wt-%, preferably between about 15 and about 18 wt-%, and still more preferably about 17 wt-%.

Figure 7:
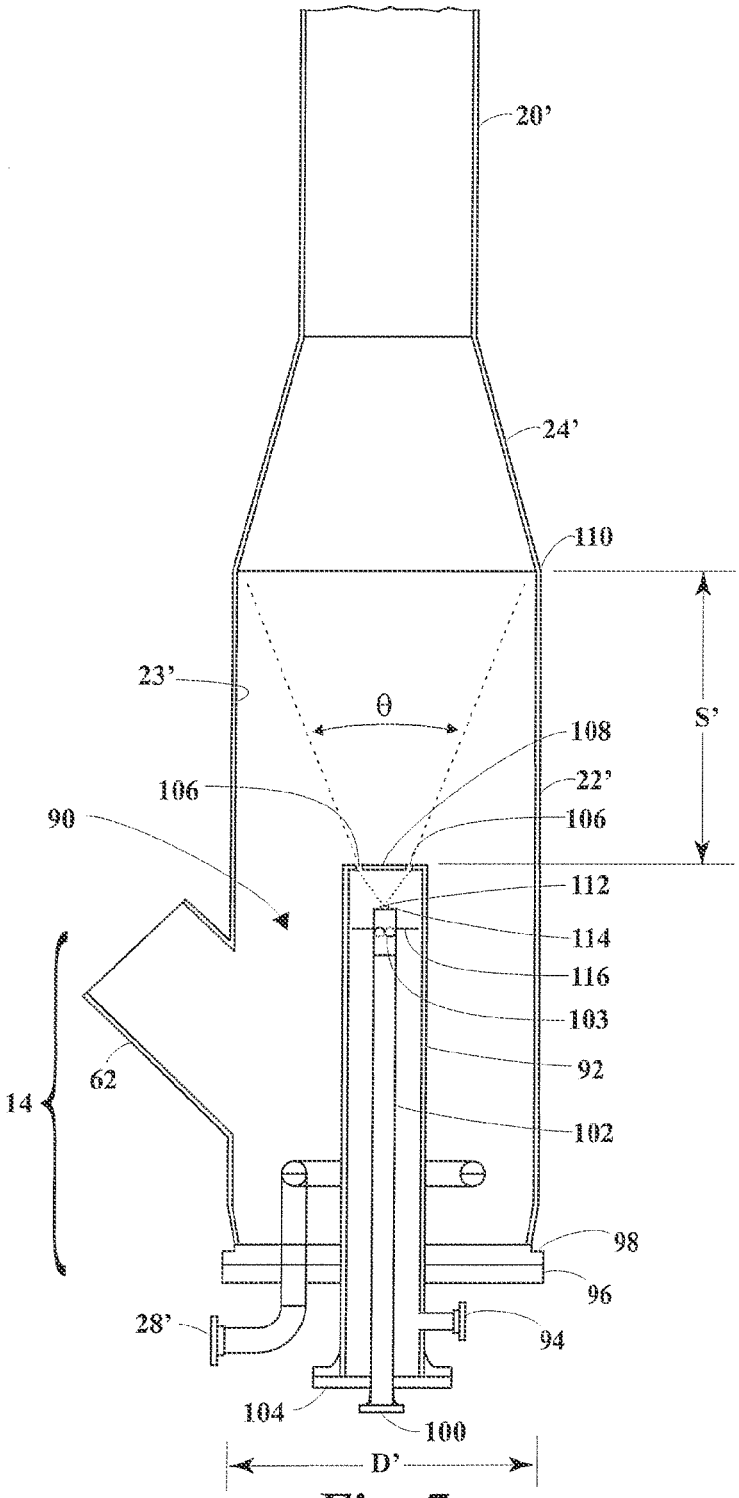
FIG. 7 is an elevational diagram showing a distributor in a central position extending up from the bottom in an enlarged lower section of a riser.
Figure 8:
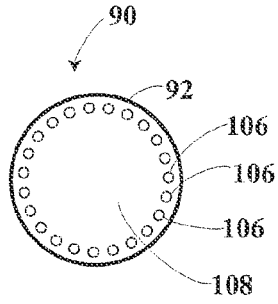
FIG. 8 is a plan view of the distributor tip of FIG. 7.

FIGS. 7 and 8 illustrate an additional embodiment of the invention. Elements in FIGS. 7 and 8 which correspond to elements in FIGS. 1-6 but with different configurations will be designated with the same reference numeral but appended with the prime symbol (′). FIGS. 7 and 8 depict a centrally located feed distributor 90 which may have a cylindrical configuration. Feed is introduced from the distributor 90 positioned near the center of the enlarged lower section 22 extending upwardly from the bottom of the enlarged lower section 22. The distributor 90 is positioned to introduce the feed into approximately the center between the side walls of the enlarged lower section 22' of the riser 20' and at an elevated position above the input of steam from a steam distributor 28' and regenerator standpipe 62 in a bottom zone 14. In an embodiment, a distributor barrel 92 receives steam from a steam inlet pipe 94 and passes around a steam disk 116 which defines a constrictive annulus with the inner surface of the distributor barrel 92. A barrel body flange 96 secures the distributor barrel 92 to the base 98 of the enlarged lower section 22' of the riser 20' by bolts or other securement. An oil inlet pipe 100 delivers hydrocarbon feed to an internal oil pipe 102. An oil inlet barrel flange 104 secures the oil inlet pipe 100 to the distributor barrel 92 by bolts. Vanes 103 in the internal oil pipe 102 cause the oil to swirl in the oil pipe before exiting. The internal oil pipe 102 distributes the swirling oil to the distributor barrel 92 where it mixes with steam which has passed the steam disk 116 and is injected from orifices, or openings, 106 in the distributor cap 108. The openings 106 in the cap 108 may comprise one circular row of holes just inside the outer perimeter of the cap as shown in FIG. 8. In an embodiment, axes of the openings 106 on the distributor 90 project at an angle with respect to vertical that projects up to an intersection 110 between the enlarged section 22' and the frusto-conical transition section 24' of the riser 20'. In a further embodiment, the swirling oil exits a single opening in a tip 114 of the internal oil pipe 102. An imaginary line from the center of the opening 112 to the openings 106 in the distributor tip 108 define an angle that may be different and preferably larger than the angle θ defined between the openings 106 and the intersection 110 with respect to the vertical. In one embodiment, hydrocarbon feed exiting the openings 106 on the distributor 90 forms a generally hollow cone spray pattern with a cone angle θ between about 20 and 50°, preferably about 30°. D' represents the diameter of the enlarged lower section 22' and S' represents the separation distance between the openings 106 and intersection 110. Feed sprayed at cone angle θ may be projected to intersect the wall of the enlarged lower section 22' and frustoconical transition section 24' at between about 50 and about 115% the distance S' from the tip of the distributor 90, preferably about 70 and about 95%.

Because the distributor 90 is centrally located in the enlarged lower section 22', openings 106 will be spaced away from the wall of the enlarged lower section by at least as much as the openings in the distributor 12 described with respect to FIGS. 1-6. In an embodiment, the openings 106 are spaced 35-50% of the diameter D' of the enlarged lower section 22' from the closest part of the inner surface of the wall 23' of the enlarged lower section. It is also contemplated that the hole pattern in the top of the distributor cap 108 can take other types of patterns such as concentric circles or other shapes. It is contemplated also that a plurality of distributors 90 protruding through the base of the enlarged lower section 22' of the riser 20' may be positioned in the enlarged lower section 22' to ensure adequate proportionation of the feed across the cross section of the enlarged lower section 22', which may be necessary for processing relatively larger feed rates. The distributors 12 and 12' are available from Bete Fogg Nozzles Inc.

Preferred embodiments of this invention are described herein, including the best mode known to the inventors for carrying out the invention. It should be understood that the illustrated embodiments are exemplary only, and should not be taken as limiting the scope of the invention.

EXAMPLE

An FCC process has a charge rate of 20,000 BPSD. The riser 20 is 0.9 meter (3 feet) in diameter with an enlarged lower section 22 1.8 meters (6 feet) in diameter. The feed is a Rubiales crude having the following properties. It has a Conradson carbon wt-% of 13.7, API gravity of 12.3, and an average molecular weight of 480.6. Furthermore, the feed has 33 ppm nickel, 125 ppm vanadium, and 1.3 wt-% sulfur.

Feed is introduced through distributors positioned above the entry of the catalyst and into the enlarged lower section 22 of the riser 20. Feed is injected through six distributors 12 spaced generally uniformly around a cross section of the enlarged lower section 22, as shown in FIG. 3, at a velocity of 30 meters per second (100 feet per second) and a pressure of 172 kPa (gauge) (25 psig). Steam is also injected through the distributors 12 with the feed at 10 wt-%. Each distributor 12 is positioned with all openings 86 in its tip 88 extending into the inside of the enlarged lower section 22 by about 30% of the diameter D of the enlarged lower section 22 away from the closest part of the wall 23 and angled upward at a 30 degree angle a to the horizon. The feed sprays from twelve openings 86 in an oval-type arrangement on the top of each tip 88. The sprayed feed forms a hollow cone spray pattern, with a vertical centerline and 60 degree cone angle β, upward into the enlarged lower section 22. Each opening 86 has a diameter of 1.6 centimeters (0.6 inch).

The upwardly injected feed mixes with a fluidized bed of catalyst. Catalyst, and steam used as a lift at about 75% steam and a velocity of 1.3 meters per second (4.2 feet per second), moves upwardly from the bottom part of the enlarged lower section 22 at a velocity of 0.2 meters per second (0.7 feet per second) to mix with the injecting feed. The mixing feed and catalyst travels up the enlarged lower section 22 at 4.7 meters per second (15.5 feet per second). The distance S from the distributor tip 88 to the top of the enlarged lower section 22, where the diameter transitions into the narrower riser 20, is 3 meters (10 feet). The velocity increases to 19 meters per second (62 feet per second) in the riser 20.

The operating conditions for the process include a catalyst to oil ratio of 9.9. The steam to the riser is 5 wt-% feed and the raw oil temperature is 232° C. (450° F.). The reactor temperature is 524° C. (975° F.) and the reactor pressure is 138 kPa (gauge) (20 psig). The heat of reaction is 109 kJ/kg feed (228 BTU/lb feed). The regenerator temperature is 666° C. (1231° F.). In addition, the heat removal is 2592 kJ/kg coke (5400 BTU/lb coke), the dry air rate 4.6 kg/kg coke (10.2 lbs/lb coke). The hydrogen in coke is 6 wt-% and the sulfur in coke is 0.8 wt-%. The conversion as produced to gasoline and lighter products 90 wt-% of which boils at 193° C. (380° F.) is 68 vol-%.

Product yield of gasoline 90 wt-% of which boiling at 193° C. (380° F.) is 38.3 wt-%, 19.7 wt-% light cycle oil 90 wt-% of which boiling at 316° C. (600° F.), 13.7 wt-% clarified oil, and 16.7 wt-% coke. At the 20,000 BPSD charge rate, 9808 BPSD of debutanized gasoline 90 wt-% of which boiling at 193° C. (380° F.), 3955 BPSD of light cycle oil 90 wt-% of which boiling at 316° C. (600° F.), 2436 BPSD of clarified oil, 7915 BPSD of depentanized gasoline, and 21,842 kg/hr (48,093 lbs/hr) of coke are produced.

The invention claimed is

1. A fluid catalytic cracking process, comprising:

combining a catalyst and a fluidizing medium in a bottom zone of an enlarged lower section of a riser in order to create a fluidized bed having a superficial gas velocity of between about 90 and about 150 centimeters per second (about 3 and about 5 feet per second), said enlarged lower section having a diameter and a wall;

passing said catalyst in said fluidized bed upwardly in said riser;

injecting a high carbon residue contaminated feedstock upwardly into said enlarged lower section from an opening positioned above said bottom zone and at a distance of at least about 10% of said diameter away from a closest part of said wall;

cracking said high carbon residue contaminated feedstock in the presence of said catalyst to produce a cracked stream; and separating said catalyst from said cracked stream.

2. The fluid catalytic cracking process according to claim 1, wherein said high carbon residue contaminated feedstock has a contamination between about 5 and about 20 weight percent.

3. The fluid catalytic cracking process according to claim 1, wherein said high carbon residue contaminated feedstock has a contamination between about 8 and about 15 weight percent.

4. The fluid catalytic cracking process according to claim 1, wherein said high carbon residue contaminated feedstock has a velocity of between about 15 and about 46 meters per second (about 50 and about 150 feet per second).

5. The fluid catalytic cracking process according to claim 1, wherein said combining step further includes a quantity of steam between about 1 and about 8 weight percent.

* * * * *